US010619637B2

(12) United States Patent
Coeckelbergs et al.

(10) Patent No.: US 10,619,637 B2
(45) Date of Patent: Apr. 14, 2020

(54) INLET VALVE AND VACUUM PUMP PROVIDED WITH SUCH AN INLET VALVE

(71) Applicant: ATLAS COPCO AIRPOWER, NAAMLOZE VENNOOTSCHAP, Wilrijk (BE)

(72) Inventors: Joeri Coeckelbergs, Wilrijk (BE); Niels Gorrebeeck, Wilrijk (BE); Dries Gielis, Wilrijk (BE); Andries De Bock, Wilrijk (BE); Glenn Vinck, Wilrijk (BE); Andries Desiron, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 279 days.

(21) Appl. No.: 15/542,845

(22) PCT Filed: Jan. 7, 2016

(86) PCT No.: PCT/BE2016/000003
§ 371 (c)(1),
(2) Date: Jul. 11, 2017

(87) PCT Pub. No.: WO2016/112440
PCT Pub. Date: Jul. 21, 2016

(65) Prior Publication Data

US 2018/0266421 A1 Sep. 20, 2018

Related U.S. Application Data

(60) Provisional application No. 62/103,723, filed on Jan. 15, 2015.

(30) Foreign Application Priority Data

Feb. 11, 2015 (BE) ..... 2015/5072

(51) Int. Cl.
*F04C 28/24* (2006.01)
*F04C 25/02* (2006.01)
(Continued)

(52) U.S. Cl.
CPC ..... *F04C 28/24* (2013.01); *F04C 25/02* (2013.01); *F04C 28/28* (2013.01);
(Continued)

(58) Field of Classification Search
CPC ..... G05D 16/0638; G05D 16/0658; G05D 16/0666; Y10T 137/7835; F04C 28/24;
(Continued)

(56) References Cited

U.S. PATENT DOCUMENTS 1,420,035 A * 6/1922 Hall ..... G05D 16/10 137/534
1,651,971 A * 12/1927 Shield ..... F16K 17/194 137/509
(Continued)

FOREIGN PATENT DOCUMENTS

CN 201391455 Y 1/2010
CN 201412337 Y 2/2010
(Continued)

OTHER PUBLICATIONS

Chinese Office Action in related Chinese Application No. 2016800058818, dated Jul. 4, 2018.
(Continued)

*Primary Examiner* — William M McCalister
(74) *Attorney, Agent, or Firm* — Bacon & Thomas, PLLC

(57) ABSTRACT

An inlet valve for regulating the pressure at the inlet channel of a vacuum pump comprising: a first chamber defined by a housing having at least one inlet channel connected to a first supply of a fluid, comprising a movable element defining two cavities fluidly sealed from each-other and means for
(Continued)

exerting a force on the movable element; a second chamber separated from the first chamber by a wall and defined by a housing, being in direct communication with a process channel of a second supply of a fluid; a valve body slidably mounted in the wall to prevent a fluid flow between the second chamber and the second cavity of the first chamber, the valve body having a distal end and a proximal end, wherein the valve body comprises a fluid channel extending through the valve body allowing a fluid flow between the first cavity and the inlet channel.

20 Claims, 4 Drawing Sheets

(51) Int. Cl.
*F04C 29/00* (2006.01)
*F04C 28/28* (2006.01)

(52) U.S. Cl.
CPC ..... *F04C 29/0092* (2013.01); *F04C 2270/19* (2013.01); *Y10T 137/7835* (2015.04)

(58) Field of Classification Search
CPC ..... F04C 28/28; F04C 25/02; F04C 29/0092; F04C 2270/19
USPC ..... 137/907, 509
See application file for complete search history.

(56) References Cited

U.S. PATENT DOCUMENTS 3,112,763 A * 12/1963 Tennis ..... F16K 17/18 137/493.5
3,164,166 A * 1/1965 Tennis ..... F16K 17/18 137/491
3,189,042 A * 6/1965 Kerley, Jr. ..... F16K 17/19 137/493.9
3,196,908 A * 7/1965 Billian ..... B67D 7/48 137/509
3,285,287 A * 11/1966 Curran ..... F16K 31/122 137/630
3,461,908 A * 8/1969 Newcomb ..... D21F 1/48 137/103
3,521,661 A * 7/1970 Staiger ..... F04D 27/0215 137/220
4,217,927 A * 8/1980 Morita ..... F16K 17/196 137/454.5
4,273,154 A * 6/1981 Moldenhauer ..... A01J 5/048 137/490
4,335,743 A * 6/1982 Jones ..... A01J 5/048 119/14.44
4,482,127 A * 11/1984 Hafele ..... F16K 31/1221 251/25
4,605,040 A * 8/1986 Meermoller ..... A01J 5/048 137/489
4,613,111 A * 9/1986 Paquet ..... F16K 31/1266 251/30.01
4,785,851 A * 11/1988 Peacock ..... F16K 51/02 251/30.02
4,921,006 A * 5/1990 Evans ..... G05D 16/163 137/492.5
4,944,249 A * 7/1990 Takeuchi ..... A01J 5/048 119/14.44
4,986,298 A * 1/1991 Martin ..... A61M 1/0031 137/15.22
5,141,403 A * 8/1992 Guo ..... A01J 5/048 119/14.25
5,195,557 A * 3/1993 Fournier ..... B67D 7/763 137/509
5,848,608 A * 12/1998 Ishigaki ..... F16K 31/1225 137/599.16
6,374,855 B1 * 4/2002 Hansen ..... F16K 7/17 137/510
6,494,229 B2 * 12/2002 Kajitani ..... F16K 1/38 137/530
6,772,787 B2 * 8/2004 Idensjo ..... A01J 5/048 119/14.44
6,814,338 B2 * 11/2004 Kajitani ..... F16K 31/1221 137/630
7,117,886 B2 * 10/2006 Kajitani ..... G05D 16/202 137/487.5
7,163,025 B2 * 1/2007 Kajitani ..... F16K 41/10 137/601.13
8,356,693 B2 * 1/2013 Franconi ..... B64D 13/02 184/5.1
8,671,987 B2 * 3/2014 Gu ..... F16K 1/52 137/630
2013/0136638 A1 * 5/2013 Foerster ..... F04C 28/06 418/1

FOREIGN PATENT DOCUMENTS

DE 102011084811 B3 12/2012
EP 0130662 A2 1/1985
EP 0391064 A1 10/1990
EP 2618000 A1 7/2013

OTHER PUBLICATIONS

International Search Report (ISR) dated May 3, 2016, for PCT/BE2016/000003.

* cited by examiner

INLET VALVE AND VACUUM PUMP PROVIDED WITH SUCH AN INLET VALVE

This invention relates to an inlet valve for regulating the pressure at the inlet of a vacuum element.

BACKGROUND OF THE INVENTION

A known problem with vacuum pumps consists in that they cannot function at high pressures for a long period of time because of the risk of thermal overload. If a vacuum pump is started at a high pressure, it will work for an extensive amount of time at maximum capacity, which generates heat and might cause a malfunction.

Another risk associated with a vacuum pump starting at a high pressure, is the elevated risk of having oil emissions at the discharge channel of the vacuum pump.

Yet another aspect that needs to be taken into account is the risk of encountering significant pressure fluctuations in a relatively short time interval at the inlet of the vacuum pump which can cause current fluctuations in the motor driving said vacuum pump, and associated unwanted effects such as the tripping of the motor.

Because of these risks, different methods for protecting the vacuum pumps have been introduced. Some vacuum pumps split the process of achieving the required pressure value in intermediate stages and use multiple pumps, others suggest a reduction of the pressure at the inlet of the vacuum pump before starting it. One significant drawback of both proposed methods is the increase in design complexity. Because the design becomes more complex, the dimensions of the overall system, the manufacturing and maintenance costs increase considerably. Another significant drawback of these vacuum pumps consists in that an extensive waiting time interval is required until the desired pressure is achieved, because either multiple stages are required, or an initial waiting time interval for lowering the pressure at the inlet of the vacuum pump is needed. Yet another drawback the these vacuum pumps is the fact that they do not solve the problems associated with sudden pressure fluctuations at the inlet of the vacuum pump. Because of this, the reliability and responsiveness of such vacuum pumps is limited.

Other methods include the use of a system of valves for regulating the pressure on the vacuum line. One example can be found in U.S. Pat. No. 4,273,154 wherein a system using two valves, a main valve and an auxiliary valve, is being introduced. The system makes use of a coil spring to generate the necessary force in order to control the position of the auxiliary valve. The vacuum line is in fluid communication with a control chamber and with a first auxiliary chamber delimited by the auxiliary valve and the spring. When the pressure in the vacuum line drops, the pressure within the first auxiliary chamber also drops. When the pressure is sufficiently low, the auxiliary valve lifts and outside air from a second auxiliary chamber enters through channels inside the vacuum line. This results in that the pressure inside the control chamber increases, causing the main valve to open and allowing a flow of outside air to enter in the vacuum line, causing the pressure therein to increase.

Due to the complex assembly of communicating channels, the module introduced by U.S. Pat. No. 4,273,154 is not sufficiently responsive to achieve a relatively constant pressure on the vacuum line. Because of such complex assembly and because the system also uses multiple membranes, the risk of malfunctions increases considerably, making the system proposed by U.S. Pat. No. 4,273,154 not only extremely complex to manufacture but also extremely costly when it comes to assembly and maintenance.

If dealing with oil injected vacuum pumps, another important aspect that needs to be taken into account is the need to maintain the oil flow within the system. For this purpose, known vacuum pumps use an oil pump to maintain the circulation of oil between the vacuum element and an oil separator. If such an oil pump would not be present or would not function properly, the pressure difference between different areas of the vacuum pump would not be sufficiently high to keep the oil circulating therein and, as a result, dangerously high temperatures and low efficiency of the vacuum process would be encountered. One of the drawbacks of known systems when using such a structure for a vacuum pump is the significant increase in manufacturing costs of the overall system and the significant increase of complexity of the overall circuit.

Yet another important aspect that needs to be taken into account when using oil injected vacuum pumps is the high risk of oil emissions within the process chamber once the vacuum element is being shut off, which means a high risk of oil contamination of the end product. An existing solution for this problem is the use of a series of valves connected on the inlet channel of the vacuum pump that allow a controlled flow of gas for a predetermined time interval after the vacuum element is being shut off. Such a solution is extremely costly and increases the complexity of the overall system.

Taking the above drawbacks into consideration, it is an object of the present invention to provide a valve regulating the pressure at the inlet of the vacuum element such that the vacuum pump can function through the entire range of pressures without being damaged. The valve according to the present invention further aims to achieve a user friendly solution for regulating the pressure at the inlet of the vacuum element.

SUMMARY OF THE INVENTION

The present invention aims to provide a solution for protecting the motor driving the vacuum pump even if high pressure fluctuations are encountered at the inlet of the vacuum pump.

Another object of the present invention is to provide a valve that eliminates the need of an oil pump, reducing considerably the costs and complexity of the overall system and improving its performance.

Yet another object of the present invention is to provide a valve that eliminates the risk of having oil emissions at the discharge channel of the vacuum pump and also eliminates the risk of having oil emissions within the vacuum chamber after the vacuum element has been shut off.

The valve according to the present invention also helps in keeping the temperature of the system within an allowable temperature range.

The present invention is directed towards an inlet valve for regulating the pressure at an inlet channel of a vacuum element, the inlet valve comprising:

- a first chamber defined by a housing having at least one inlet channel connected to a first supply of a fluid, the first chamber comprising a movable element defining a first cavity and a second cavity fluidly sealed from each-other and means for exerting a force on the movable element;
- a second chamber separated from the first chamber by a wall and defined by said housing, said second chamber being in direct communication with a process channel of a second supply of a fluid;

a valve body slidably mounted in the wall in such a way as to prevent a fluid flow between the second chamber and said second cavity of the first chamber, the valve body having a distal end extending into the first cavity of the first chamber and a proximal end, said valve body being movable between an initial closed state in which the proximal end is pushed against a sealing flange and a second, opened state, in which a fluid is allowed to flow between the process channel and the inlet channel of the vacuum element; wherein the valve body comprises a fluid channel extending through the valve body allowing a fluid flow between the first cavity and the inlet channel of the vacuum element.

An advantage of the inlet valve according to the present invention consists in that, due to the force exerted on the movable element and because the second cavity of the first chamber is fluidly sealed from the first cavity of the first chamber, the pressure therein not being influenced by any pressure variations within the process channel or the vacuum element, the valve will prevent a fluid flow between the process channel and the vacuum element for a sufficiently long time interval such that the vacuum element reaches a desired working speed and temperature, making the vacuum element using a valve as in the present invention much more efficient and reliable.

Accordingly, by allowing the vacuum element to reach a desired working speed before being connected to the process channel, the valve according to the present invention protects the motor from experiencing significant speed fluctuations due to a sudden change of the pressure at the inlet of the vacuum element.

Preferably the desired working speed is lower than a maximum allowed speed of the vacuum element such that, if the pressure in the process channel is relatively high, the motor would still have a speed interval in which it will function within nominal parameters without any risk of tripping.

Preferably, if the pressure at the inlet channel of the vacuum element, $P_{element}$, is lower than a minimum set value, the valve is opened by slidably moving the valve body against the force exerted on the movable element in the direction of the first chamber, lifting the proximal end of the valve body from the sealing flange and allowing a fluid flow between the process channel and the inlet channel of the vacuum element.

By using an inlet valve according to the present invention the vacuum pump can be used at any process pressure, from a relatively high pressure such as atmospheric pressure, until a minimum permitted pressure, without any time intervals in which the pump would be stopped and without any need of reducing the pressure at the inlet channel of the vacuum element.

Another advantage of the present invention is that, due to the fluid communication between the first cavity of the first chamber and the inlet channel of the vacuum element, and to the fact that the first cavity of the first chamber is connected to a first supply of fluid, the pressure difference between the first cavity and the second cavity of the first chamber is keeping the inlet valve in a closed state until the vacuum element reaches the a safe working speed and temperature.

Accordingly the vacuum pump is used at a maximum efficiency and the motor is protected throughout the complete working cycle, because, once the pressure at the inlet of the vacuum element will experience fluctuations, the pressure difference between the first cavity of the first chamber and the second cavity of the first chamber will cause the valve to move in to a closed state or in a relatively closed state. This reduces the influence of the pressure difference between, on the one hand, the process channel, and on the other hand, the inlet channel of the vacuum element, upon the speed of the vacuum element.

Because the valve is kept in a closed state until the vacuum element reaches optimal working speed and temperature, the vacuum pump using an inlet valve according to the present invention requires a drive system with a much lower capacity, reducing the manufacturing costs of the system.

Another significant advantage of a valve according to the present invention consists in that, once the vacuum element is being shut off, the proximal end of the valve body will remain pushed against the sealing flange, keeping the valve in a closed state and not allowing any fluid flow between the vacuum element and the process channel. Because of such a behavior the risk of having oil entering the process channel immediately after the vacuum element is being turned off is minimized. Moreover, because of a relatively constant fluid flow between the first cavity of the first chamber and the inlet channel of the vacuum element, the risk of having oil emissions within the process chamber is further minimized or even excluded.

Because of the relatively constant fluid flow, the valve according to the present invention acts as a non-return valve.

Another advantage offered by the inlet valve consists in that, once the vacuum element is turned off, the rotors within the vacuum element will immediately stop without experiencing an induced movement in the opposite direction, further reducing the risk of having oil entering within the process channel due to a back rotation movement of the rotors in the vacuum element.

Yet another advantage offered by the inlet valve consists in that the pressure difference created within the circuit is sufficient to maintain a constant flow of oil for performing the oil injection. Accordingly, the need of an oil pump is eliminated, significantly reducing the complexity of the vacuum pump, the manufacturing and maintenance costs.

Preferably, a valve according to the present invention can be used in oil injected vacuum pumps and in oil free vacuum pumps.

Preferably, the second cavity of the first chamber further comprises an inlet channel fluidly connecting said second cavity to a supply of a first fluid at a pressure $P_1$. Accordingly, a better control of the pressure values at which the valve opens and/or closes is achieved, since both the first cavity and the second cavity of the first chamber are connected to the first supply of a fluid. Once the vacuum element is started, the pressure within the first cavity of the first chamber decreases under the influence of the vacuum element, until the pressure within the second cavity of the first chamber becomes sufficiently high compared to the pressure within the first cavity of the first chamber, which allows the valve body to slidably move towards the first cavity of the first chamber and to allow a flow of fluid between the process channel and the inlet channel of the vacuum element.

According to another preferred characteristic of the invention, the first fluid is air and $P_1$ is the atmospheric pressure.

Preferably the distal end of the valve body extending into the first cavity of the first chamber has a surface area much smaller than the sectional surface area of the body of the valve (the section being performed on the length of the body, between the distal end and the proximal end), such that the pressure drop at the level of the distal end is much higher than the pressure drop throughout the body of the valve. Accordingly the pressure difference over the movable element is low enough to enable the spring to bring the valve in a closed state when the pressure value at the inlet channel of the vacuum element reaches a relatively high pressure value.

Because the second cavity of the first chamber is connected to the atmosphere, and because of the structural characteristic of the vacuum pump, the valve will be brought in an opened state when the pressure of the fluid at the inlet channel of the vacuum element reaches vacuum pressure. Accordingly, because of the pressure difference, the body of the valve will move against the force exerted on the movable element and will allow a flow of fluid between the process channel and the inlet channel of the vacuum element.

The present invention is further directed to a method for regulating the pressure at the inlet channel of the vacuum element, the method comprising the steps of:

- providing a first chamber delimited by a housing, an inlet channel connected to a first supply of a fluid, and a movable element defining two cavities fluidly sealed from each other;
- providing a means for generating a force on the movable element;
- providing a second chamber separated from the first chamber by a wall, further defined by said housing, said second chamber being in direct communication with a process channel of a second supply of a fluid;
- providing a valve body and slidably mounting said valve body in the wall in such a way as to prevent a fluid flow between the second chamber and the second cavity of the first chamber, mounting the valve body such that a distal end thereof extends into the first cavity of the first chamber, said valve body being movable between an initial closed state in which a proximal end of said valve body is pushed against a sealing flange and a second, opened state, in which a fluid flows between the process channel and the inlet channel of the vacuum element.

The valve according to the present invention regulates the pressure at the inlet channel of the vacuum element by:

- providing a channel through the valve body for fluidly connecting the first cavity with the inlet channel of the vacuum element;
- starting the vacuum element;
- if the pressure $P_{element}$ is lower than a set value, moving the valve body into said second open state; and
- if the pressure $P_{element}$ is higher than a set value, slidably moving the valve body into said initial closed state.

BRIEF DESCRIPTION OF THE DRAWINGS

With the intention to better showing the characteristics of the invention, a preferred structure of the inlet valve according to the present invention is described hereinafter by way of an example without any limiting nature, with reference to the accompanying drawing, wherein.

DETAILED DESCRIPTION OF THE INVENTION

Figure 1:
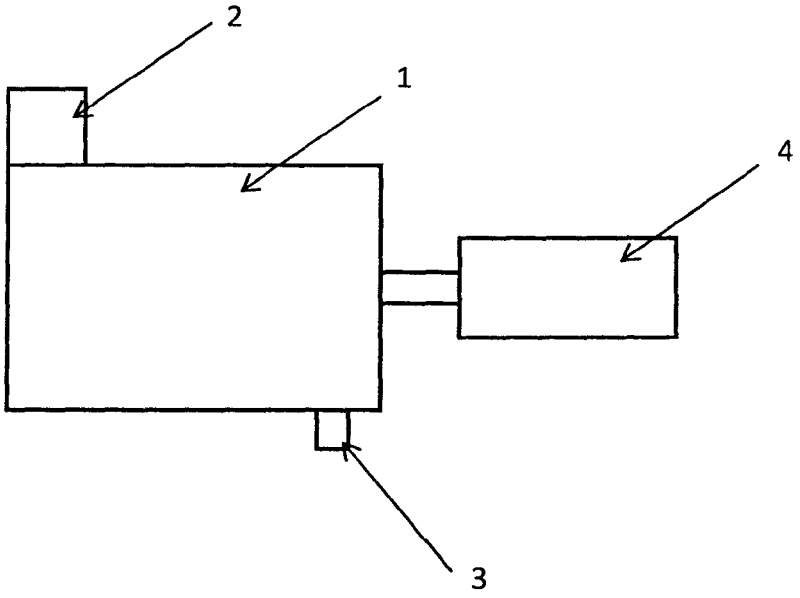
FIG. 1 represents a schematic view of a vacuum pump according to the present invention.

FIG. 1 shows a vacuum element 1 comprising an inlet valve 2 according to the present invention, a discharge channel 3 and driving means 4.

In the context of the present invention, it is to be understood that the vacuum element 1 is part of a vacuum pump which can be selected from a group comprising: a single toothed vacuum pump, a double toothed vacuum pump, a claw vacuum pump, a scroll vacuum pump, a turbo vacuum pump, a screw vacuum pump, a rotary vane vacuum pump, etc. Each of the mentioned types of vacuum pumps can be oil free or oil injected.

In the context of the present invention it is to be understood that a vacuum element 1 comprises at least a rotor enclosed within a chamber. For ease of explanation, the rotational speed of the at least one rotor of the vacuum element 1 is hereinafter referred to as the speed of the vacuum element 1.

Preferably, said driving means 4 can be a motor such as a combustion engine or an electrical motor, a turbine such as a water turbine or a steam turbine, or the like.

The driving means 4 can be directly driven or can be driven by an intermediate transmission system like a coupling or a gear box.

Figure 2:
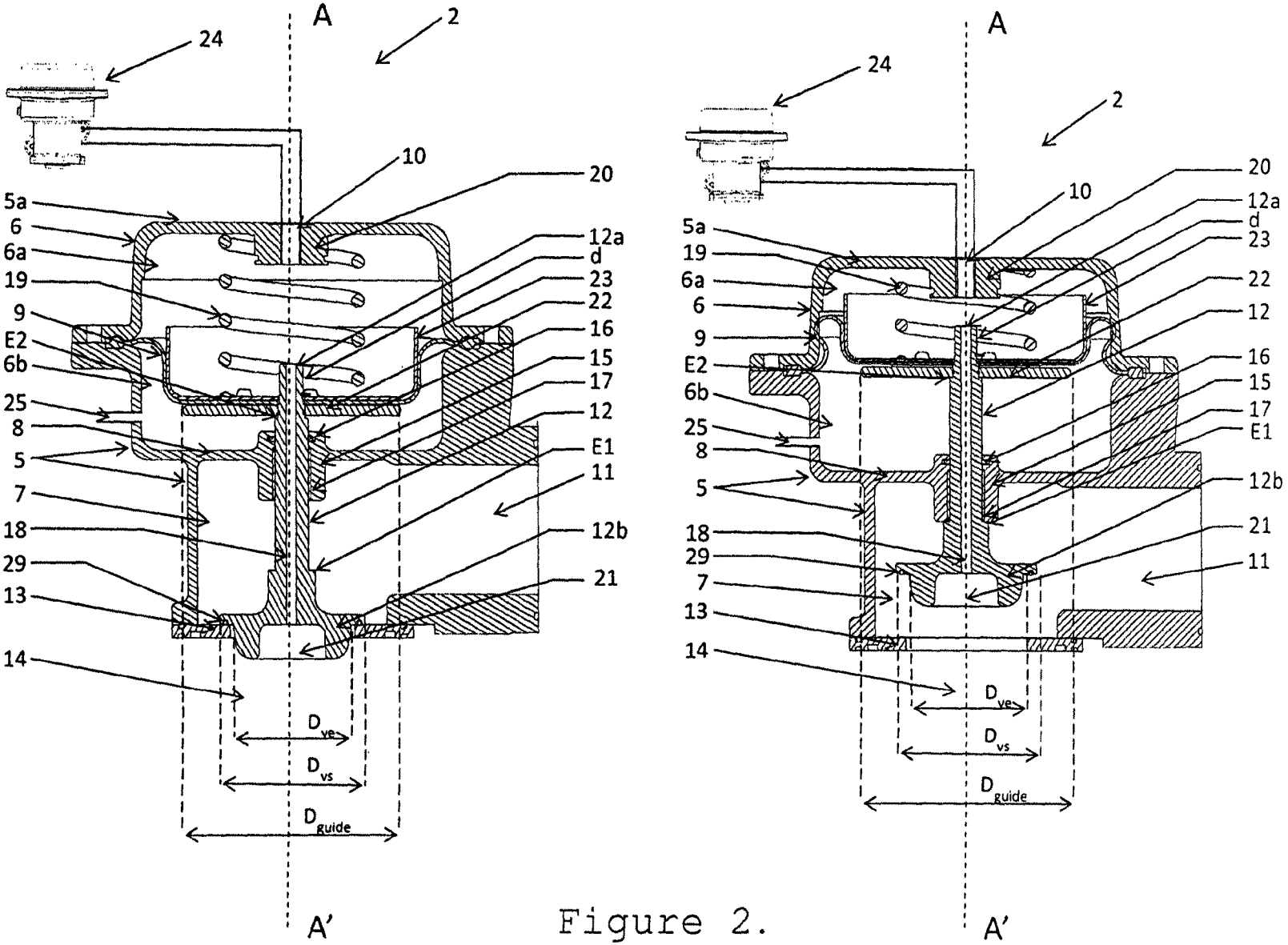
FIG. 2 represents an inlet valve for regulating the pressure at the inlet channel of a vacuum element according to an embodiment of the present invention.

FIG. 2 shows an inlet valve 2 comprising a housing 5 delimiting a first chamber 6 and a second chamber 7 separated by a wall 8. The first chamber 6 comprises a movable element 9 that defines a first cavity **6*a* and a second cavity 6*b* fluidly sealed from each other. The first cavity 6*a* comprising an inlet channel 10 connected to a first supply of a fluid, and means for exerting a force on the movable element 9**.

Preferably, said wall 8 acts as a separation between the second chamber 7 and, the second cavity **6*b* of the first chamber 6**.

The housing 5 in this case comprises a lid **5*a***.

In this case, the inlet channel 10 is provided centrally on the lid **5*a* opposite from the second cavity 6*b***.

The second chamber 7 is in direct communication with a process channel 11 of a supply of a fluid and further comprises therein a valve body 12 having a distal end **12*a* extending into the first cavity 6*a* of the first chamber 6 and a proximal end 12*b*, said valve body 12 being movable between an initial closed state in which the proximal end 12*b* is pushed against a sealing flange 13 and a second, opened state, in which a fluid flows from the process channel 11 to the inlet channel 14 of the vacuum element 1**.

In the context of the present invention it is to be understood that the housing 5 can be made by one integral part or several separate parts.

The valve body 12 is slidably mounted in the wall 8 in such a way as to prevent a fluid flow between the second chamber 7 and the second cavity **6*b* of the first chamber 6**.

Preferably, the sealing flange 13 is forming an opening towards the inlet channel 14 of the vacuum element 1.

In a preferred embodiment according to the present invention the valve body 12 is mounted within a guide 15 comprising a seal 16 and a bushing 17 mounted at the level of the guide 15 to eliminate the risk of encountering any residual fluid flow between the second cavity 6*b* of the first chamber 6 and the second chamber 7.

Preferably the valve body 12 comprises a fluid channel 18 extending through said valve body 12 allowing a fluid flow between the first cavity 6*a* and the inlet channel 14 of the vacuum element 1. Accordingly, the pressure within the first cavity 6*a* will have the same value as the pressure value of the fluid at the inlet channel 14 of the vacuum element 1.

In a preferred embodiment according to the present invention, the fluid channel 18 does not comprise any means for closing off said fluid channel 18 such as a valve, a lid or the like.

In the context of the present invention, it is to be understood that the fluid channel 18 can be manufactured in a different manner as long as it allows a fluid flow between the first cavity 6*a* and the inlet channel 14 of the vacuum element 1.

Preferably, said means for exerting a force on the movable element 9 can be in the shape of: a spring, a piston or a metal plate such as a steel plate for which exerting a force on the movable element 9 is intrinsic in the material properties. The force generated on the movable element 9 can either be compressive or tensile.

In a preferred embodiment according to the present invention, the means for exerting a force on the movable element 9 comprise a spring 19 positioned in the first cavity 6*a* and pushing on said movable element 9.

The spring 19 can be positioned centrally within said cavity 6*a* of the first chamber 6 and pushing on a centrally positioned surface on the movable element 9.

Preferably, the housing 5 comprises a collar 20 around the inlet channel 10 for positioning said spring 19 and keeping it in a stable central position. The inlet channel 10 can be positioned concentrically with respect to said collar 20.

In another embodiment according to the present invention, the inlet channel 10 can be positioned anywhere on the surface of said lid 5*a* like for example on the lateral sides of the lid 5*a*, relative to a central position.

Preferably, the valve body 12 extends through the second cavity 6*b* of the first chamber 6, perforates the movable element 9 and extends into the first cavity 6*a* of the first chamber 6, through the center of the spring 19, for a sufficiently long distance such that the distal end 12*a* of the valve body 12 is maintained in the first cavity 6*a* for the complete stroke of the body of the valve 12: from a closed state to a maximum opened state.

Accordingly, the adjustment of the pressure value at which the proximal end 12*b* lifts from the sealing flange 13 can be achieved by modifying the force generated by the spring 19 on the movable element 9 by reducing or increasing the stiffness and/or rigidity of the spring 19 and/or by modifying the pressure value of the fluid from the second cavity 6*b* of the first chamber 6.

Preferably, the spring 19 is generating in an initial closed state a force $F_1$ of less than 3000N (Newton), more preferably the spring 19 is generating a force $F_1$ of less than 2000N, even more preferably, the spring 19 is generating a force $F_1$ of 1000N or less.

In a preferred embodiment, the spring 19 is generating in an initial closed state a force F1 in the range from 500-2000N.

Figure 3:
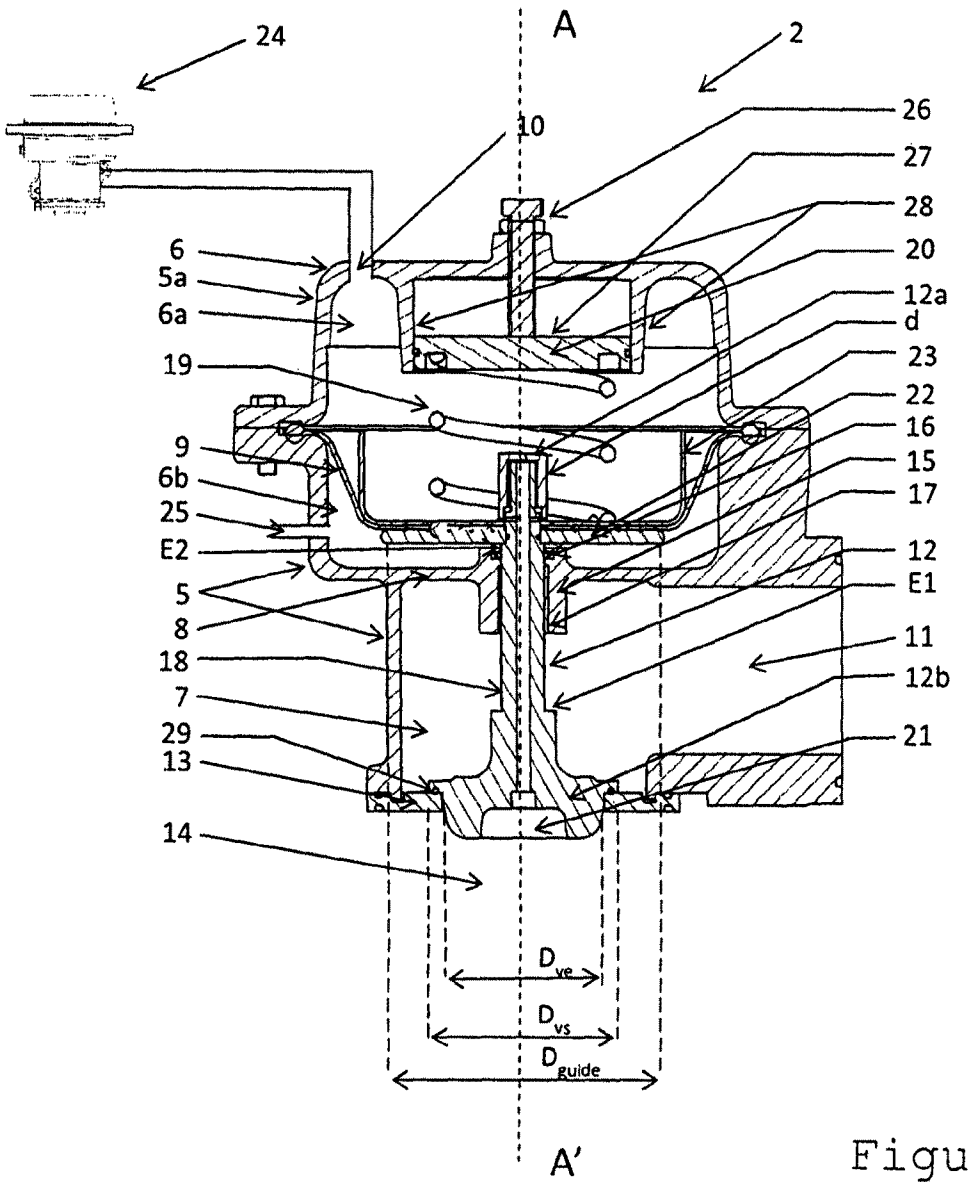
FIG. 3 represents an inlet valve for regulating the pressure at the inlet channel of a vacuum element according to another embodiment of the present invention.

In another embodiment according to the present invention, the force generated by the spring 19 can be adjusted by means of a screw 26 acting upon the spring 19 and modifying its length (FIG. 3).

Preferably, the screw 26 is acting upon a plate 27 which is in direct contact with the spring 19 and is guided between a first position in which is in direct contact with the lid 5*a* and a second maximum position in the direction of the second chamber 7, wherein the plate 27 is pushing onto said spring 19.

Preferably, the plate 27 is guided within a rim 28 extending between the lid 5*a* and said second maximum position in the direction of the second chamber 7.

Preferably, the proximal end 12*b* pushing against the sealing flange 13 is in the shape of a frustum of a cone with rounded edges having the base with the biggest diameter at the end facing the second chamber 7 and the base with the smallest diameter at the end facing inlet channel 14 of the vacuum element 1.

This offers the advantage that, regardless of the proximal end 12*b*, as soon as it is lifted from the sealing flange 13, a fluid will flow between the process channel 11 and the inlet channel 14 of the vacuum element 1, allowing for the pressure within a process chamber (not shown) to gradually be influenced by the action of the vacuum element 1.

Preferably, the proximal end 12*b* has a hollow cavity 21 at the end facing the inlet channel 14 of the vacuum element 1.

This offers the advantage that once the pressure difference between the first cavity 6*a* and the second cavity 6*b* of the first chamber 6 is high enough, the proximal end 12*b* of the valve body 12 pushing against the sealing flange 13 will be pushed in the direction of the first chamber 6 in a stable controlled movement. Accordingly, the risk of the valve body 12 to misalign with respect to the opening formed by said sealing flange 13 due to differently oriented forces that act upon the surface of the proximal end 12*b* is minimized.

The first chamber 6 can be of any geometrical shape creating a symmetry relative to a central point. Such a shape can be selected from a group comprising: a cylinder, a cone, a pyramid or any other shape.

Preferably the valve body 12 is in the shape of a rod.

In another embodiment according to the present invention the second cavity 6*b* of the first chamber 6 can further comprise a means of generating a force (compressive or tensile) on the movable element 9, said means being in the shape of a spring (not shown), or a piston, or a metal plate, positioned relatively central within said second cavity 6*b* between the wall 8 and the movable element 9 and generating a force $F_2$, said second spring affecting the pressure value at which the inlet valve 2 changes its state to opened and/or closed.

In another preferred embodiment according to the present invention, the inlet valve 2 comprises two guiding elements 22 and 23 for guiding the movable element 9: the first guiding element 22 being positioned in the second cavity 6*b* of the first chamber 6 between the movable element 9 and the wall 8 separating the first chamber 6 and the second chamber 7, and the second guiding element 23 being positioned in the first cavity 6*a* of the first chamber 6, between the movable element 9 and the spring 19.

These guiding elements 22 and 23 protect the movable element 9 from any damages that can be caused by the spring 19 by increasing the surface area where the force generated by the spring 19 acts upon, and by eliminating the risk of encountering a punctual force that could perforate said movable element 9.

Yet another effect of the guiding elements 22 and 23 consists in that a controlled movement of the body of the valve 12 is maintained on the axis AA'.

The movable element 9 can be in the shape of a piston, or a metal plate. Preferably, the movable element 9 is a membrane fixed in the housing 5 of the first chamber 6.

If the movable element 9 is a membrane, said membrane can be manufactured from any type of material such as natural or synthetic rubber, or a shape memory material.

The advantage offered by said a membrane is that it acts as a seal between the first cavity 6*a* and the second cavity 6*b* of the first chamber 6, minimizing the risk of the two cavities 6*a* and 6*b* to influence each other's pressure values.

Depending on the material such membrane is manufactured from, or the elasticity of such material, the membrane can also create an additional force acting against the force generated by the spring 19 or in the same direction with it and consequently influencing the pressure value at which the proximal end 12*b* lifts from the sealing flange 13.

In another embodiment according to the present invention the first guiding element 22 is in the shape of a cylindrical block with a hollow carving created on the side facing the wall 8 for receiving the guide 15 therein.

In another embodiment according to the present invention the first guiding element 22 is in the shape of a disk having a hole therein for receiving the valve body 12.

The second guiding element 23 can be in the shape of a disk against which, on one side the spring 19 is resting, and has a hole therein for receiving the valve body 12.

Preferably, the guiding element 23 comprises a circumferential rim extending towards the lid 5*a*.

In the context of the present invention it is to be understood that said guiding elements 22 and 23 can have any shape, as long as they allow a controlled movement of the valve body 12 and allow for said valve body 12 to extend into the first cavity 6*a*.

In a preferred embodiment according to the present invention, for achieving a better guiding mechanism of the valve body 12 through the wall 8, different sectional diameters for the valve body 12 are being created throughout its length.

Accordingly a first modification of the sectional diameter is creating edge $E_1$ which determines the maximum distance the valve body 12 can travel within the second chamber 7, until the edge $E_1$ pushes against the guide 15.

The sectional diameter determined by the first edge $E_1$ is maintained on the length of the valve body 12 in the direction of the first chamber 6, until a second edge $E_2$ is created, at a minimum distance above the guide 15, within the second cavity 6*b* of the first chamber 6.

The second edge $E_2$ is pushing against the first guiding element 22, maintaining a synchronized movement between the valve body 12 and the membrane 9.

The section between $E_1$ and $E_2$ determines the stroke distance of the valve body 12 in such a way that there is no fluid communication between the second chamber 7 and the second cavity 6*b* of the first chamber 6.

From the second edge $E_2$ until the distal end 12*a* of the valve body 12, a diameter d is created such that a fluidly flow is prevented between the second cavity 6*b* and the first cavity 6*a*.

The length of the valve body 12 between the second edge $E_2$ and the distal end 12*a* is chosen such that the distal end 12*a* is maintained at all times within the first cavity 6*a* of the first chamber 6.

Turning to the structure of the proximal end 12*b*, a section having a significantly bigger diameter, $D_{vs}$, compared to the diameter of the valve body 12 is created. This section is created to overlap with the sealing flange 13 such that the fluid flow between the process channel 11 and the inlet channel 14 of the vacuum element 1 is completely stopped when the inlet valve 2 is in a closed state.

In this example, the proximal end 12*b* is further designed as a frustum of a cone wherein the base having the biggest diameter is preferably but not necessarily starting to form from a diameter $D_{ve}$ in direct contact with the section having the diameter $D_{vs}$.

Preferably, the diameter $D_{ve}$ is smaller than the section having the diameter $D_{vs}$ such that the sealing flange 13 overlaps with the section having the diameter $D_{vs}$ on the surface created between $D_{vs}$ and $D_{ve}$, for a complete interruption of the fluid flow between the process channel 11 and the inlet channel 14 of the vacuum element 1.

For increased sealing properties, a rubber rim 29 can be attached at the level of the opening towards the inlet channel 14 of the vacuum element 1. Such a rubber rim 29 can be positioned for example on the sealing flange 13 on the opening itself, or it can be attached on the proximal end 12*b*, or it can be positioned on the surface created between $D_{vs}$ and $D_{ve}$ either on the sealing flange 13 or on the distal end 12*b*.

This structural characteristic offers the advantage that the fluid flow between the process channel 11 and the inlet channel 14 of the vacuum element 1 can be gradually varied from a minimum to a maximum flow, allowing the inlet valve 2 according to the present invention to be reliable and responsive to any variation of the pressure value at the inlet channel 14 of the vacuum element 1 and relative to the pressure value of the second cavity 6*b* of the first chamber 6.

As can be seen from FIG. 1, the diameter of the first guiding element 22, $D_{guide}$ is significantly bigger if compared with the diameter $D_{vs}$ of the section pushing against the sealing flange 13.

This offers the advantage that the pressure difference between the second cavity 6*b* and the first cavity 6*a* of the first chamber 6 has a much more significant influence on the pressure value at which the valve body 12 is brought in an opened and/or closed state than the pressure difference between the process channel 11 and the inlet channel 14 of the vacuum element 1.

In another embodiment according to the present invention, the second cavity 6*b* of the first chamber 6 further comprises an inlet channel 25 fluidly connecting said second cavity 6*b* to a supply of a first fluid at pressure $P_1$.

Preferably, the first fluid is air and $P_1$ is the atmospheric pressure.

Such features will allow an accurate control of the pressure in an easily buildable device.

For controlling the volume of fluid flowing though the inlet channel 10 of the first cavity 6*a* of the first chamber 6 and through the body of the valve 12 towards the inlet channel 14 of the vacuum element 1, the inlet channel 10 of the first cavity 6*a* of the first chamber 6 further comprises means for sealing said first cavity 6*a* from the fluid flow at pressure $P_1$.

In a preferred embodiment according to the present invention, said means for sealing said first cavity 6*a* from the fluid flow is a sealing valve 24.

Accordingly the flow of air at atmospheric pressure within the inlet channel 14 of the vacuum element 1 can be stopped, creating a completely closed circuit relative to the outside environment and allowing for the vacuum element 1 to efficiently influence the pressure within the process chamber.

The present invention is further directed to a method for regulating the pressure at the inlet channel 14 of a vacuum element 1, the method comprising the steps of: providing a first chamber 6 delimited by a housing 5, connecting the first chamber 6 through an inlet channel 10 to a first supply of a fluid, creating two cavities 6*a* and 6*b* within said first chamber 6 by mounting a movable element 9 and providing means 19 for generating a force on the movable element 9. The movable element 9 preventing a fluid flow between the first cavity 6*a* and the second cavity 6*b*.

The method further comprises the step of providing a second chamber 7 within said housing 5 and separated from the first chamber 6 by a wall 8. The second chamber 7 being in direct communication with a process channel 11 of a second supply of a fluid. A valve body 12 is slidably mounted in the wall 8 in such a way as to prevent a fluid flow between the second chamber 7 and the second cavity 6*b* of the first chamber 6. Said valve body 12 is mounted is such a way that the distal end 12*a* extends into the first cavity 6*a* of the first chamber 6 and the proximal end 12*b* is pushed against a sealing flange 13 in an initial closed state, said proximal end 12*b* being moved in a second open state in the direction of the first chamber 6, in which a fluid is allowed to flow between the process channel 11 and the inlet channel 14 of the vacuum element 1.

The method of the present invention further comprises the step of fluidly connecting the first cavity 6*a* of the first chamber 6 with the inlet channel 14 of the vacuum element 1 by means of a channel 18 provided through the valve body 12. Said channel 18 maintains the pressure value in the first cavity 6*a* at the same value as the pressure value at the inlet channel 14 of the vacuum element 1.

When the vacuum element 1 is started, the pressure of the fluid at the level of the inlet channel 14 will be gradually modified with the aim of reaching the level of vacuum pressure. The pressure value at the level of the first cavity 6*a* of the first chamber 6 follows the same pattern.

Once the vacuum pressure is reached, the pressure difference between the first cavity 6*a* and the second cavity 6*b* of the first chamber 6 allows the valve body 12 to slidably move against the force generated on the movable element 9 in the direction of the first chamber 6, lifting the proximal end 12*b* of the valve body 12 from the sealing flange 13 and allowing a fluid flow between the process channel 11 and the inlet channel 14 of the vacuum element 1.

Because the pressure value at the level of the second cavity 6*b* is relatively constant, once the pressure value at the inlet channel 14 of the vacuum element 1 reaches the value of the vacuum pressure, the valve body 12 is slidably moving through the wall 8 in the direction of the first chamber 6, against the force exerted on the movable element 9 such that fluid is allowed to flow between the process channel 11 and the inlet channel 14 of the vacuum element 1. Accordingly, the pressure value at the inlet channel 14 of the vacuum element 1 is being modified.

Because of the structural characteristic of the inlet valve 2, the flow of fluid between the process channel 11 and the inlet channel 14 of the vacuum element 1 is continuously regulated in such a way that, as soon as the pressure value at the inlet channel 14 of the vacuum element 1 reaches a value sufficiently high, the pressure difference between the first cavity 6*a* and the second cavity 6*b* will be sufficiently low to push the valve body 12 in the direction of the force generated on the movable element 9 with a sufficiently high force such that the proximal end 12*b* moves towards the sealing flange 13 and reduces the volume of fluid flowing from the process channel 11 to the inlet channel 14 of the vacuum element 1. If the pressure at the inlet channel 14 of the vacuum element 1 is still too high, the proximal end 12*b* of the valve body 12 is pushed against the sealing flange 13, completely stopping the fluid flow between the process channel 11 and the inlet channel 14 of the vacuum element 1.

In a preferred embodiment according to the present invention, the pressure value at which the proximal end 12*b* of the valve body 12 is lifted from the sealing flange and/or is pushed against the sealing flange 13 is adjusted depending on the application at which the vacuum pump is connected to.

The method according to the present invention has the advantage that the pressure at the inlet channel 14 of the vacuum element 1 is kept at a relatively constant value. Depending on the application such an inlet valve 2 is used in, or the properties of vacuum pump connected therein the pressure value $P_1$ can be adjusted such that the pressure value at the inlet channel 14 of the vacuum element 1 is kept at a desired value, maintaining the vacuum pump at nominal working parameters.

Another advantage of a method according to the present invention consists in that, because of the fluid channel 18, a flow of fluid can be injected into the inlet channel 14 of the vacuum element 1 as soon as the vacuum element 1 is being shut off. Because of this the effect of a back rotation of the rotors within the vacuum element 1 is avoided.

Another advantage of injecting fluid within the inlet channel 14 of the vacuum pump as soon as the vacuum element 1 is shut off consists in that the pressure difference between the inlet channel 14 and an outlet channel (not shown) of the vacuum element 1 is reduced.

Figure 4:
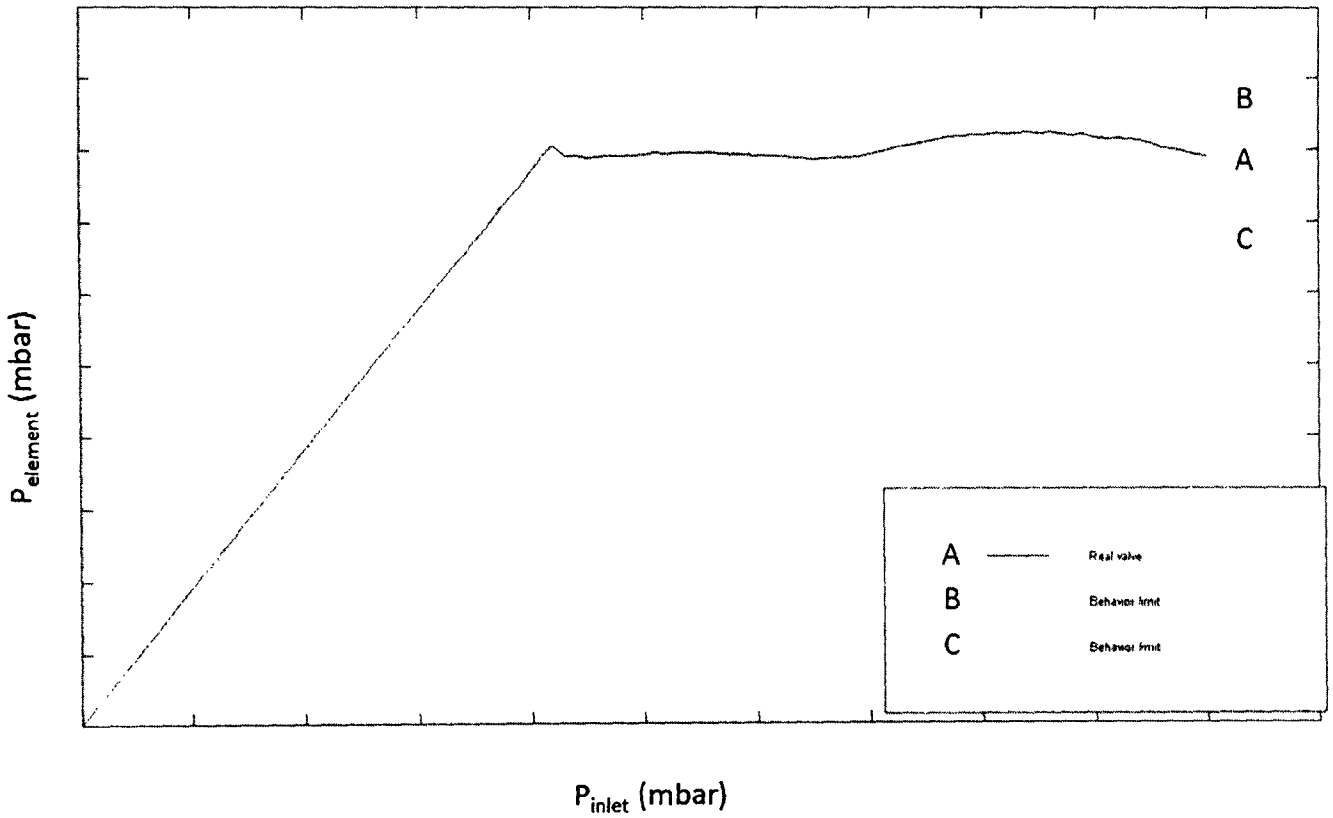
FIG. 4 represents a schematic representation of the pressure variation at the inlet channel of a vacuum element comprising an inlet valve according to an embodiment according to the present invention.

In a preferred embodiment, the method according to the present invention is keeping the pressure value of the fluid at the inlet channel 14 of the vacuum element 1, $P_{element}$, at the same value as the pressure value of the fluid in the process channel 11, $P_{process}$, when the process pressure $P_{process}$ is below 400 mbar, and at a relatively constant value of 400 mbar when the pressure of the fluid in the process channel 11 has a value higher than 400 mbar (FIG. 4).

In the context of the present invention it is to be understood that the value of 400 mbar can be modified depending on the process the vacuum pump is connected to. For example, such a value can be any selected value comprised within the interval, and not limiting to: 200-800 mbar.

The tolerance used for keeping the pressure at the inlet channel 14 of the vacuum element 1 at a relatively constant value is preferably below 20%, more preferably below 10%, even more preferably below 5%.

One of the advantages of a method according to the present invention consists in that, with the help of a relatively simple structural configuration, the life span of a vacuum pump is increased.

Another advantage is that dangerously high temperatures or pressures at the discharge channel 3 of the vacuum pump are avoided.

In a preferred embodiment according to the present invention the method controls the volume of fluid flowing between the process channel 11 and the inlet channel 14 of the vacuum element 1 through the proximal end 12*b* of the valve body 12 pushing against the sealing flange 13, said proximal end 12*b* being provided in the shape of a frustum of a cone with rounded edges having the base with the biggest diameter at the end facing the second chamber 7 and the base with the smallest diameter at the end facing the inlet channel 14 of the vacuum element 1.

For a better control of the pressure value at which the valve body 12 starts to slidably move through the wall 8 and in the same direction as the force exerted on the movable element 9, the second cavity 6*b* of the first chamber 6 is connected through an inlet channel 25 to a supply of fluid at pressure P1.

Preferably, for creating an easy to build design, said supply of fluid at pressure $P_1$ is the first supply of a fluid.

In a preferred embodiment according to the present invention the movable element 9 is a membrane fixed within the housing 5 and/or wherein the movement of the membrane 9 is guided by two guiding elements 22 and 23: a first guiding element 22 positioned within the second cavity 6*b* of the first chamber 6 between the membrane 9 and wall 8 separating the first chamber 6 and the second chamber 7 and a second guiding element 23 positioned within the first cavity 6*a* of the first chamber 6, between the membrane 9 and the means for exerting a force on said membrane 9.

Preferably the first fluid is air at an atmospheric pressure, $P_1$.

For a better control of the volume of fluid entering in the first cavity 6*a* of the first chamber 6 and modifying the pressure value at the inlet channel 14 of the vacuum element 1, said first cavity 6*a* is sealed from the fluid flow at pressure $P_1$ by means of a sealing valve 24.

In a preferred embodiment according to the present invention, after the vacuum element 1 is started, the sealing valve 24 is in open state, connecting the first cavity 6*a* of the first chamber 6 to a supply of fluid at pressure $P_1$ and therefore allowing a fluid flow throughout the valve 2. Because the second cavity 6*b* of the first chamber 6 is also connected to the supply of fluid at pressure $P_1$, the valve 2 is kept in a closed state, allowing for the speed of the vacuum element 1 to reach a predetermined value before it is connected to the process channel 11. Once the predetermined speed value is reached, the sealing valve 24 is preferably brought into a closed state which causes the pressure within the first cavity 6*a* of the first chamber 6 to be directly influenced by the vacuum element 1. This causes the valve 2 to be brought into an open state and, accordingly the process channel 11 to be connected to the vacuum element 1.

In the context of the present invention it is to be understood that allowing the speed of the vacuum element 1 to reach a predetermined value can mean either increasing the speed or decreasing the speed of the vacuum element 1.

Because the sealing valve 24 is brought into a closed state only after the pre-determined speed is reached, and therefore only when the process channel 11 is connected to the vacuum element 1, the motor 4 driving the vacuum element 1 is protected from encountering sudden pressure variations that would cause high speed variations and eventually the motor 4 to trip.

If the request for vacuum stops at the level of a process chamber (not shown) being in direct fluid communication with the process channel 11, the vacuum element 1 is disconnected from said process chamber but it is preferably kept for a preset time interval in working parameters, such that if a request for vacuum is encountered within said preset time interval, the vacuum element 1 can be again connected to the process chamber. When this happens, the sealing valve 24 is preferably opened, such that, even if the pressure at the level of the process chamber is much higher than the pressure within the vacuum element 1, the valve 2 will continue to prevent a fluid flow between the process channel 11 and the inlet channel 14 of the vacuum element 1 until the predetermined speed of the vacuum element 1 is reached, eliminating the risk of the motor 4 driving the vacuum element 1 to trip.

Depending on the vacuum element 1 used, the predetermined speed can be any value selected between 600-4600 rpm (rotations per minute). Preferably the predetermined speed is selected as being lower than 4200 rpm, more preferably is selected as being lower than 4000 rpm, even more preferably is selected as being 3500 rpm or lower.

In another embodiment according to the present invention, for increasing the efficiency of the vacuum pump, when the pressure at the inlet channel 14 of the vacuum element 1 reaches the value of 400 mbar, the sealing valve 24 is closed, sealing the first cavity 6*a* from said fluid flow and allowing the vacuum element 1 to influence the pressure value on the process channel 11 at maximum yield.

The present invention is further directed to the use of a valve as described herein as a valve regulating the pressure at the inlet channel 14 of a vacuum element 1 wherein said valve is mounted between the process chamber (not shown) and the inlet channel 14 of the vacuum element 1.

The present invention is further directed to a vacuum pump being provided with an inlet valve 2 according to the present invention.

The present invention is by no means limited to the embodiment described as an example and shown in the drawings, but such an inlet valve 2 can be realized in all kinds of variants, without departing from the scope of the invention.

The invention claimed is:

1. An inlet valve for regulating a pressure at an inlet channel of a vacuum element comprising:

a first chamber defined by a housing having at least one inlet connected to a first supply of a fluid, the first chamber comprising a movable element defining a first cavity and a second cavity fluidly sealed from each other and a material for exerting a force on the movable element;

a second chamber separated from the first chamber by a wall and defined by said housing, said second chamber being in direct communication with a process channel of a second supply of a fluid;

a valve body slidably mounted in the wall in such a way as to prevent a fluid flow between the second chamber and said second cavity of the first chamber, the valve body having a distal end extending into the first cavity of the first chamber and a proximal end, said valve body being movable between an initial closed state in which the proximal end is pushed against a sealing flange at the inlet channel of the vacuum element and a second, opened state, in which a fluid is allowed to flow between the process channel and the inlet channel of the vacuum element;

wherein the valve body comprises a fluid channel extending through the valve body allowing a fluid flow between the first cavity and the inlet channel of the vacuum element, and wherein the valve body is configured in a way such that a maximum distance the valve body is able to travel in the second chamber does not close off the fluid channel to always allow the fluid flow between the first cavity and the inlet channel of the vacuum element.

2. The inlet valve according to claim 1, wherein the material for exerting a force on the movable element comprise a spring positioned in the first cavity and pushing on said movable element.

3. The inlet valve according to claim 2, wherein the spring is generating in an initial closed state a force $F_1$ in the range from 500-2000N.

4. The inlet valve according to claim 1, wherein the proximal end pushing against the sealing flange is in the shape of a frustum of a cone with rounded edges having the base with the biggest diameter at the end facing the second chamber and the base with the smallest diameter at the end facing the inlet channel of the vacuum element.

5. The inlet valve according to claim 1, wherein the proximal end has a hollow cavity at the end facing the inlet channel of the vacuum element.

6. The inlet valve according to claim 1, wherein the movable element is a membrane fixed in the housing of the first chamber.

7. The inlet valve according to claim 2, wherein the movement of the movable element is guided by two guiding elements, the first guiding element is positioned in the second cavity of the first chamber between the movable element and the wall separating the first chamber and the second chamber, and the second guiding element is positioned in the first cavity of the first chamber, between the movable element and the spring.

8. The inlet valve according to claim 1, wherein the second cavity of the first chamber further comprises an inlet fluidly connecting said second cavity to a supply of a first fluid at pressure $P_1$.

9. The inlet valve according to claim 8, wherein the first fluid is air and $P_1$ is atmospheric pressure.

10. The inlet valve according to claim 1, wherein the at least one inlet of the first cavity of the first chamber further comprises a sealer for sealing said first cavity from a fluid flow at pressure $P_1$.

11. The inlet valve according to claim 10, wherein the sealer for sealing said first cavity from the fluid flow is a sealing valve.

12. A method for regulating the pressure at an inlet channel of a vacuum element, the method comprising the steps of:

providing a first chamber delimited by a housing, an inlet connected to a first supply of a fluid, and a movable element defining two cavities fluidly sealed from each other;

providing a material for generating a force on the movable element;

providing a second chamber separated from the first chamber by a wall, further defined by said housing, said second chamber being in direct communication with a process channel of a second supply of a fluid;

providing a valve body and slidably mounting said valve body in the wall in such a way as to prevent a fluid flow between the second chamber and the second cavity of the first chamber, mounting the valve body such that a distal end thereof extends into the first cavity of the first chamber, said valve body being movable between an initial closed state in which a proximal end of said valve body is pushed against a sealing flange and a second, opened state, in which a fluid flows between the process channel and the inlet channel of the vacuum element;

wherein the method further comprises:

providing a channel through the valve body for fluidly connecting the first cavity with the inlet channel of the vacuum element, wherein the valve body is configured in a way such that a maximum distance the valve body is able to travel in the second chamber does not close off the fluid channel so that the first cavity is always fluidly connected to the inlet channel of the vacuum element;

starting the vacuum element;

if the pressure $P_{element}$ is lower than a set value, moving the valve body into said second open state; and if the pressure $P_{element}$ is higher than a set value, moving the valve body into said initial closed state.

13. The method according to claim 12, wherein the pressure of the fluid at the inlet channel of the vacuum element, $P_{element}$ has the same value as the pressure value of the fluid in the process channel, $P_{process}$ when the process pressure $P_{process}$ is below 400 mbar.

14. The method according to claim 12, wherein the pressure of the fluid at the inlet channel of the vacuum element, $P_{element}$ has a relatively constant value of 400 mbar when the pressure of the fluid in the process channel has a value higher than 400 mbar.

15. The method according to claim 12, wherein the second cavity of the first chamber is connected through an inlet to a supply of a fluid at pressure $P_1$.

16. The method according to claim 15, wherein the supply of a fluid is the first supply of a fluid.

17. The method according to claim 12, wherein the movable element is a membrane fixed within the housing and/or wherein the movement of the membrane is guided by two guiding elements: a first guiding element positioned within the second cavity of the first chamber between the membrane and wall separating the first chamber and the second chamber and the second guiding element positioned within the first cavity of the first chamber, between the membrane and the material for exerting a force on said membrane.

18. The method according to claim 12, wherein said first fluid is air and $P_1$ is the atmospheric pressure.

19. The method according to claim 12, wherein the said first cavity is sealed from the fluid flow at pressure $P_1$ by a sealing valve.

20. A method of using a valve according to claim 1, comprising regulating the pressure at the inlet channel of a vacuum element wherein said valve is mounted between a process chamber and the inlet channel of the vacuum element.

* * * * *